US005820486A

United States Patent [19]

Tanaka et al.

[11] Patent Number: 5,820,486

[45] Date of Patent: Oct. 13, 1998

[54] GOLF BALL

[75] Inventors: Hiroaki Tanaka, Kobe; Keiji Moriyama, Shirakawa, both of Japan

[73] Assignee: Sumitomo Rubber Industries Ltd., Hyogo-ken, Japan

[21] Appl. No.: 687,198

[22] Filed: Jul. 25, 1996

[30] Foreign Application Priority Data

Jul. 25, 1995 [JP] Japan ..... 7-209969

[51] Int. Cl.[6] ..... A63B 37/12

[52] U.S. Cl. ..... 473/374; 473/373; 473/378; 273/6

[58] Field of Search ..... 473/374, 378, 473/373

[56] References Cited

U.S. PATENT DOCUMENTS

| | | | |
|---|---|---|---|
| 4,919,434 | 4/1990 | Saito | 473/373 |
| 5,439,227 | 8/1995 | Egashira et al. | 473/377 |
| 5,586,950 | 12/1996 | Endo | 473/373 X |

*Primary Examiner*—George J. Marlo
*Attorney, Agent, or Firm*—Birch, Stewart, Kolasch & Birch, LLP

[57] ABSTRACT

A solid golf ball having a good shot feel and controllability as well as an excellent flight performance and durability which comprises a core and a cover covering the core, wherein the cover has a two layer structure composed of an outer cover and an inner cover, wherein the inner cover is prepared from a resin composition having a flexural modulus of 5,000 to 12,000 Kgf/cm$^2$ and comprising a polyamide resin having a flexural modulus of 6,000 to 30,000 Kgf/cm$^2$ with a thermoplastic elastomer having a JIS/A hardness of 30 to 98, in a weight ratio of polyamide: thermoplastic elastomer within the range of 95:5 to 50:50.

7 Claims, 1 Drawing Sheet

GOLF BALL

FIELD OF THE INVENTION

The present invention relates to a golf ball. More particularly, it relates to a solid golf ball having a good feel at the time of hitting and controllability as well as excellent flight performance and durability.

BACKGROUND OF THE INVENTION

Golf balls are roughly classified into two groups, one group is solid golf balls and the other group is thread wound golf balls. The solid golf balls are superior in flight performance and durability and the thread wound golf balls are superior in controllability and shot feel at the time of hitting. Among the solid golf balls, the two piece solid golf ball composed of a core and a cover covering the core is mainly utilized by consumers because of excellent flight performance and good durability. However, poor controllability and poor shot feel have been posed as an area of needed improvement.

In order to improve the controllability, Japanese Kokoku Publication 5 (1993)-4110 suggests that the cover of the two piece solid golf ball is made of two layers, and Japanese Kokai Publication 7 (1995)-24085 improves the two layered cover of the two piece solid golf ball by making the outer cover softer than the inner cover.

The two piece solid golf ball having the two layered cover, as proposed above, does not have sufficient durability, controllability and rebound characteristics and therefore should be improved more. The proposal of the outer cover being softer than the inner cover enhances controllability and durability, but rebound characteristic is poor because of the soft outer cover and also flight distance is reduced.

OBJECTS OF THE INVENTION

An object of the present invention is to solve the above problems of a conventional solid golf ball, thereby providing a golf ball wherein shot feel and controllability are improved without a deterioration in flight performance and durability.

This object as well as other objects and advantages of the present invention will become apparent to those skilled in the art from the following description with reference to the accompanying drawings.

The present invention will become more fully understood from the detailed description given hereinbelow and the accompanying drawings which are given by way of illustration only, and thus are not limitative of the present invention, and wherein:

SUMMARY OF THE INVENTION

Figure 1:
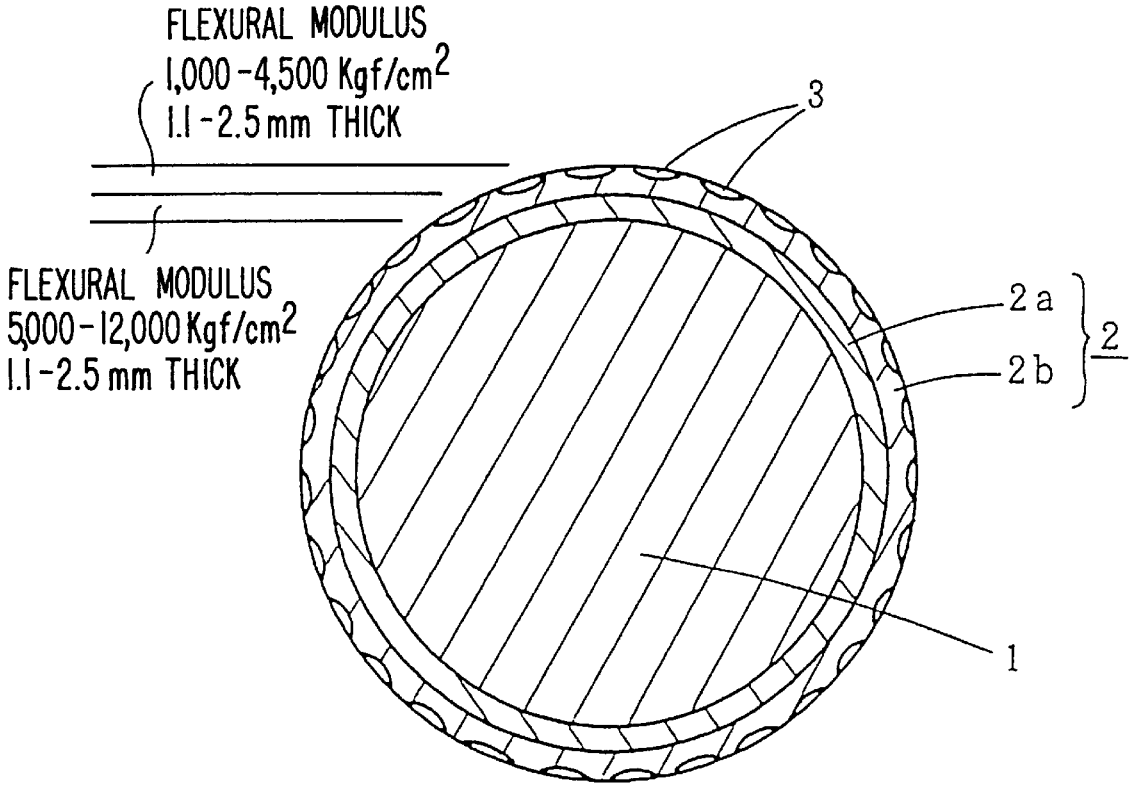
FIG. 1 is a schematic cross section illustrating one embodiment of the golf ball of the present invention.

The present invention provides a golf ball comprising a core and a cover covering the core, the cover having a two layer structure composed of an outer cover and an inner cover, wherein the inner cover is prepared from a resin composition having a flexural modulus of 5,000 to 12,000 Kgf/cm$^2$, prepared by mixing a polyamide resin having a flexural modulus of 6,000 to 30,000 Kgf/cm$^2$ with a thermoplastic elastomer having a JIS-A hardness of 30 to 98 in a weight ratio of polyamide:thermoplastic elastomer within the range of 95:5 to 50:50.

In the present invention, the inner cover employs a combination of a polyamide resin and a thermoplastic elastomer, which makes it possible to provide both rebound characteristics and controllability without causing a deterioration in the flight performance and durability.

The polyamide resin has a flexural modulus of 6,000 to 30,000 Kgf/cm$^2$, preferably 8,000 to 25,000 Kgf/cm$^2$. The "flexural modulus" used throughout the specification is determined at a temperature of 23° C. and an equilibrium of a relative moisture of 50%. If the flexural modulus is less than 6,000 Kgf/cm$^2$, rebound characteristics is poor and if it is more than 30,000 Kgf/cm$^2$, durability is lowered. Typical examples of the polyamide resins are Nylon-12, Nylon-11, Nylon-6, Nylon-6,6, Nylon-6,12, Nylon-6,10, Nylon-4,6 and the like.

The thermoplastic elastomer has a JIS-A hardness of 30 to 98, preferably 60 to 95. JIS-A hardness is comparable to Shore A hardness. If the elastomer has a JIS-A hardness of less than 30, the cover is too soft and reduces rebound characteristics. If it is more than 98, the cover is too hard and reduces shot feel. Typical examples of the thermoplastic elastomer are styrene-butadiene-styrene block copolymer, maleic anhydride-modified styrene-butadiene-styrene block copolymer, ethylene-ethyl acrylate copolymer, maleic anhydride-modified ethylene-ethyl acrylate copolymer and the like. The thermoplastic elastomer which has been modified with maleic anhydride is preferred, in order to enhance dispersibility and mixing ability when mixing with the polyamide. The elastomer modified with maleic anhydride enhances rebound characteristics and durability.

The polyamide resin is mixed with the thermoplastic elastomer in a weight ratio of polyamide:thermoplastic elastomer of 95:5 to 50:50. If the polyamide resin is less than 50% of the mixture, the cover does not have sufficient hardness and reduces rebound characteristics, and if the polyamide is more than 95% of the mixture, the inner cover is too hard and causes a deterioration in the shot feel.

The inner cover is prepared from a resin composition composed of the polyamide resin and the thermoplastic elastomer. The resin composition may contain a pigment, such as titanium dioxide and barium sulfate; and other additives, such as antioxidant, if necessary.

The resin composition for the inner cover is required to have a flexural modulus of 5,000 to 12,000 Kgf/cm$^2$. If it is less than 5,000, rebound characteristics are poor and if it is more than 12,000 Kgf/cm$^2$, shot feel is poor.

The outer cover may be prepared from a resin composition having a flexural modulus of 1,000 to 4,500 Kgf/cm$^2$, preferably 1,500 to 4,000 Kgf/cm$^2$. If the outer cover has a flexural modulus of less than 1,000, rebound characteristics are lowered, and if it is more than 4,500 Kgf/cm$^2$, controllability is poor and shot feel is also poor. The resin composition of the outer cover mainly contains an ionomer resin. Examples of the ionomer resin which is commercially available from Mitsui Du Pont Polychemical Co., Ltd. include ionomer resins such as Hi-milan 1605 (Na), Hi-milan 1707 (Na), Hi-milan AM7318 (Na), Hi-milan 1706 (Zn), Hi-milan 1652 (Zn), Hi-milan 1705 (Zn), Hi-milan AM7315 (Zn), Hi-milan AM7317 (Zn), Hi-milan AM7311 (Mg), Hi-milan MK7320 (K), etc.; and terpolymer ionomer resins such as Hi-milan 1856 (Na), Hi-milan 1855 (Zn), Hi-milan AM7316 (Zn), etc. Examples of the ionomer resin which is commercially available from Du Pont Co., U.S.A. include ionomer resins such as Surlyn 8920 (Na), Surlyn 8940 (Na), Surlyn AD8512 (Na), Surlyn 9910 (Zn), Surlyn AD8511 (Zn), Surlyn 7930 (Li), Surlyn 7940 (Li), etc.; and terpolymer ionomer resins such as Surlyn AD8265 (Na), Surlyn AD8269 (Na), etc. Examples of the ionomer resin which is commercially available from Exxon Chemical Co. include lotek 7010 (Zn), 8000 (Na), etc. In addition, Na, Zn, K, Li, Mg, etc., which are described in parenthesis following the trade name of the above ionomer resin, mean neutralizing metal ion species thereof. The resin composition for the outer cover may contain pigment, such as titanium dioxide and barium sulfate, and other additives such as antioxidant, if necessary.

The inner cover preferably has a thickness of 1.1 to 2.5 mm and the outer cover preferably has a thickness of 1.1 to 2.5 mm. If the inner cover has a thickness of less than 1.1 mm, rebound characteristics are deteriorated, and it is more than 2.5 mm, shot feel is poor. If the outer cover has a thickness of less than 1.1 mm, durability is lowered, and if it is more than 2.5 mm, shot feel is poor.

The golf ball of the present invention is formed by covering the inner cover and outer cover on a core. The core can be either a solid core for a solid golf ball or a thread wound core for a thread wound golf ball. Preferred is the solid core, in view of flight performance and durability.

The solid core can be either a core having uniform structure or a core having two or more layer structure. The solid core is generally formed from vulcanized rubber. The vulcanized rubber is formed from a rubber composition which is generally used for golf balls, but preferably comprising 100 parts by weight of polybutadiene rubber, 10 to 60 parts by weight of a vulcanizing agent (crosslinking agent), 3 to 30 parts by weight of a filler (e.g. zinc oxide, barium sulfate), 0.1 to 5 parts by weight of a peroxide (e.g. dicumyl peroxide) and optionally 0.1 to 1 part by weight of an antioxidant. Examples of the vulcanizing agent (crosslinking agent) are an α,β-ethylenic unsaturated carboxylic acid, such as acrylic acid and methacrylic acid; a metal salt thereof; and a polyfunctional monomer, such as trimethylolpropane trimethacrylate. The rubber composition is generally subjected to press vulcanization, that is press mold at a temperature of 140° to 180° C. for 10 to 60 minutes to obtain a spherical vulcanized material.

The core is covered with the inner cover and outer cover, but covering may be conducted by conventional method. For example, an inner cover resin composition is formed into two semi-spherical half shells which encapsulate the core, and then is press molded at a temperature of 10° to 170° C. for 1 to 15 minutes. Or an inner cover resin composition is directly injection-molded on the core to encapsulate the core. The outer core is covered on the inner-covered core in the same method as used for the covering of the inner cover.

The structure of the golf ball of the present invention is explained by referring the drawing. FIG. 1 schematically shows an embodiment of the golf ball of the present invention. In FIG. 1, 1 shows a core, and 2 shows a cover covering the core. The cover 2 is composed of an inner cover 2*a* and an outer cover 2*b*. On the outer cover 2*b*, suitable number of dimples 3 are disposed in a suitable manner. On the golf ball, paint and marks are applied, if necessary.

EXAMPLES

The present invention is illustrated in detail by the following Examples which, however, are not to be construed as limiting the present invention to their details.

Examples 1 to 5 and Comparative Examples 1 to 5

Golf balls of Examples 1–5 and Comparative Examples 1–5 were prepared by the following steps (i) to (iii).

Step (i) Production of core

A rubber composition was prepared by mixing 100 parts by weight of polybutadiene (available from Japan Synthetic Rubber as BR-11; cis-1,4 content of 96%), 36 parts by weight of zinc acrylate, 20 parts by weight of zinc oxide, 1.2 parts by weight of dicumyl peroxide and 0.5 parts by weight of antioxidant (available from Yoshitomi Seiyaku as Yoshinox 425). It was then press-molded or vulcanized at a temperature of 160° C. for 25 minutes to obtain a solid core. The solid cores had a diameter of 35.1 mm for Examples 1–3 and Comparative Examples 1–5 and a diameter of 36.3 mm for Examples 4 and 5. The change of the core diameter was conducted for changing a cover thickness.

Step (ii) Production of cover composition

Inner cover layer resin compositions and outer cover layer resin compositions were prepared from the ingredients shown in Tables 1 and 2. Table 1 shows the ingredients of the inner cover layer resin compositions and the outer cover layer resin composition for Examples 1–5, and Table 2 shows those for Comparative Examples 1–5. The unit of the amount of the respective ingredients to be formulated is "parts by weight". In Tables, the names of the ingredients are shown as tradename or abbreviation, but the details are explained after Table 2. Tables 1 and 2 only show resin components, but 2 parts by weight of titanium dioxides based on 100 parts by weight of the total resin components was added into the resin composition in all Examples and Comparative Examples.

TABLE 1

| | Examples | | | | |
|---|---|---|---|---|---|
| | 1 | 2 | 3 | 4 | 5 |
| Inner cover layer resin composition | | | | | |
| Nylon 12 *1 | 80 | 0 | 0 | 80 | 60 |
| Nylon 11 *2 | 0 | 95 | 80 | 0 | 0 |
| Tufftec M 1943 *3 | 20 | 5 | 0 | 0 | 0 |
| AR 201 *4 | 0 | 0 | 20 | 0 | 40 |
| Tufftec H 1052 *5 | 0 | 0 | 0 | 20 | 0 |
| Outer cover layer resin composition | | | | | |
| Hi-milan 1706 *6 | 20 | 20 | 0 | 20 | 0 |
| Hi-milan 1555 *7 | 5 | 5 | 0 | 5 | 0 |
| Hi-milan 1855 *8 | 75 | 75 | 100 | 75 | 0 |
| Iotek 8000 *9 | 0 | 0 | 0 | 0 | 50 |
| Hi-milan AM 7315 *10 | 0 | 0 | 0 | 0 | 50 |

TABLE 2

| | Comparative Examples | | | | |
|---|---|---|---|---|---|
| | 1 | 2 | 3 | 4 | 5 |
| Inner cover layer resin composition | | | | | |
| Nylon 12 *1 | 100 | 40 | 40 | 0 | 0 |
| Tufftec M 1943 *3 | 0 | 60 | 0 | 0 | 0 |
| Tufftec H 1052 *5 | 0 | 0 | 60 | 0 | 0 |
| Iotek 8000 *9 | 0 | 0 | 0 | 0 | 70 |
| Hi-milan AM 7315 *10 | 0 | 0 | 0 | 0 | 30 |
| Polycarbonate *11 | 0 | 0 | 0 | 100 | 0 |
| Outer cover layer resin composition | | | | | |
| Hi-milan 1706 *6 | 20 | 0 | 0 | 20 | 20 |
| Hi-milan 1555 *7 | 5 | 0 | 0 | 5 | 5 |
| Hi-milan 1855 *8 | 75 | 0 | 0 | 75 | 75 |

TABLE 2-continued

| | Comparative Examples | | | | |
|---|---|---|---|---|---|
| | 1 | 2 | 3 | 4 | 5 |
| Iotek 8000 *9 | 0 | 50 | 50 | 0 | 0 |
| Hi-milan AM 7315 *10 | 0 | 50 | 50 | 0 | 0 |

*1 Nylon 12: Polyamide resin available from Toray Industries Inc. as Rilsan AMNO, having a flexural modulus of 11,000 Kgf/cm$^2$.
*2 Nylon 11: Polyamide resin available from Toray Industries Inc. as Lirusan BMNO, having a flexural modulus of 10,000 Kgf/cm$^2$.
*3 Tufftec M 1943: Partially hydrogenated styrene-butadiene-styrene block copolymer which is modified with maleic anhydride, available from Asahi Chemical Industries Co., Ltd., having a JIS-A hardness of 67°.
*4 AR 201: Ethylene-ethyl acrylate copolymer which is modified with maleic anhydride, available from Mitsui Du Pont Polychemical Co., Ltd., having JIS-A hardness of 51.
*5 Tufftec H 1052: Partially hydrogenated styrene-butadiene-styrene block copolymer, available from Asahi Chemical Industries Co., Ltd., having a JIS-A hardness of 67°.
*6 Hi-milan 1706: Ethylene-methacrylic acid copolymer ionomer, neutralized with Zn ion, available from Mitsui Du Pont Chemical Co., Ltd., having a flexural modulus of about 2,600 Kgf/cm$^2$.
*7 Hi-milan 1555: Ethylene-methacrylic acid copolymer ionomer, neutralized with Na ion, available from Mitsui Du Pont Chemical Co., Ltd., having a flexural modulus of about 2,550 Kgf/cm$^2$.
*8 Hi-milan 1605: Ethylene-methacrylic acid copolymer ionomer, neutralized with Na ion, available from Mitsui Du Pont Chemical Co., Ltd., having a flexural modulus of about 3,100 Kgf/cm$^2$.
*9 Iotek 8000: Ethylene-acrylic acid copolymer ionomer, neutralized with Na ion, available from Exxon Chemical Co., having a flexural modulus of about 4,000 Kgf/cm$^2$.
*10 Hi-milan AM 7315: Ethylene-methacrylic acid copolymer ionomer, neutralized with Zn ion, available from Mitsui Du Pont Chemical Co., Ltd., having a flexural modulus of about 4,500 Kgf/cm$^2$.
*11 Polycarbonate: Available from Mitsubishi Gas Chemical Co., Ltd. as S-1000, having a flexural modulus of 23,000 Kgf/cm$^2$.

The resulting inner cover layer resin composition and outer cover layer resin composition show flexural modulus as shown in Table 3 and 4. The flexural modulus was determined using a stiffness tester available from Toyo Seimitsu Co., Ltd. at 23° C. and a relative moisture of 50%, according to ASTM D-747. A sample for the test was prepared by heat-pressing each the cover layer resin composition into a plate having about 2 mm thickness which was then kept for 2 weeks at 23° C. and a relative moisture of 50%.

Step (iii) Production of golf ball

The core obtained in Step (i) was covered with the inner cover layer resin composition obtained in Step (ii) by injection molding to form an inner layer covered core. The inner layer covered core was covered with the outer cover layer resin composition obtained in Step (ii) by injection molding to form a large size solid golf ball having a diameter of 42.7 mm.

The resulting golf ball was subjected to an evaluation of ball weight, ball deformation amount, rebound coefficient, flight distance (carry) by a No.1 wood, spin amount by a sand wedge, durability and shot feel when hitting and the results are shown in Table 3 and 4.

Evaluations of ball deformation amount, rebound coefficient, flight distance, spin amount, durability and shot feel were determined as follow.

Ball deformation amount

A deformation of a golf ball from an application of 10 Kg on the ball to an application of 130 Kg on the ball was determined.

Rebound coefficient

A ball was struck by a cylindrical metal material having 198.4 g at a speed of 45 m/s, using a R&A (British Golf Association) initial velocity measuring apparatus and the rebound coefficient was calculated from its initial velocity of the ball.

Flight distance due to No. 1 wood club:

A No. 1 wood club is mounted to a Swing robot manufactured by True Temper Co., and then a golf ball is hit at a head speed of 45 m/second to measure the distance to the point reaching on the ground (carry).

Spin amount due to a sand wedge

A sand wedge having a face angle of 56° is mounted to a Swing robot manufactured by True Temper Co., and then a golf ball is hit at a head speed of 22 m/second. The spin amount is determined by continuously taking the photograph of the hit golf ball.

Durability:

A ball is struck with a metal plate by an air gun at a ball speed of 45 m/s and number of shoot until the ball breaks is determined. The result is shown as an index which is calculated as number of shoot of Example 1 being 100.

Shot feel:

It is evaluated by hitting a golf ball with a No. 1 wood club due to 10 top professional golfers. The evaluation criteria is shown as Good, Fairly Good, Poor and Very Poor. The results shown in the Tables below are based on the fact that not less than 8 out of 10 professional golfers evaluated with the same criterion.

TABLE 3

| | Examples | | | | |
|---|---|---|---|---|---|
| | 1 | 2 | 3 | 4 | 5 |
| Inner cover layer: | | | | | |
| Flexural modulus (Kgf/cm$^2$) | 6,000 | 11,000 | 7,000 | 7,000 | 5,000 |
| Thickness (mm) | 1.9 | 1.9 | 1.9 | 1.6 | 1.6 |
| Outer cover layer: | | | | | |
| Flexural modulus (Kgf/cm$^2$) | 1,500 | 1,500 | 1,000 | 1,500 | 4,500 |
| Thickness (mm) | 1.9 | 1.9 | 1.9 | 1.6 | 1.6 |
| Ball weight (g) | 45.2 | 45.1 | 45.2 | 45.2 | 45.2 |
| Ball deformation amount (mm) | 2.8 | 2.4 | 3.2 | 2.9 | 2.6 |
| Rebound coefficient | 0.806 | 0.790 | 0.785 | 0.799 | 0.806 |
| FIight distance (yards) | 232.2 | 231.5 | 230.9 | 230.8 | 230.9 |
| Spin amount (rpm) | 5,500 | 6,000 | 6,000 | 5,500 | 5,100 |
| Durability (index) | 100 | 115 | 120 | 107 | 108 |
| Shot feel | Good | Good | Good | Good | Good |

TABLE 4

| | Comparative Examples | | | | |
|---|---|---|---|---|---|
| | 1 | 2 | 3 | 4 | 5 |
| Inner cover layer: | | | | | |
| Flexural modulus (Kgf/cm$^2$) | 11,000 | 3,500 | 3,500 | 28,000 | 6,000 |
| Thickness (mm) | 1.9 | 1.9 | 1.9 | 1.9 | 1.9 |
| Outer cover layer: | | | | | |
| Flexural modulus (Kgf/cm$^2$) | 1,500 | 4,800 | 4,800 | 1,500 | 1,500 |
| Thickness (mm) | 1.9 | 1.9 | 1.9 | 1.9 | 1.9 |
| Ball weight (g) | 45.3 | 45.2 | 45.3 | 45.2 | 45.1 |
| Ball deformation amount (mm) | 2.5 | 3.2 | 3.2 | 2.6 | 2.8 |
| Rebound coefficient | 0.758 | 0.750 | 0.760 | 0.750 | 0.765 |
| Flight distance (yards) | 225.7 | 226.4 | 225.1 | 226.9 | 226.9 |
| Spin amount (rpm) | 5,700 | 4,600 | 5,100 | 3,900 | 4,100 |

TABLE 4-continued

| | Comparative Examples | | | | |
|---|---|---|---|---|---|
| | 1 | 2 | 3 | 4 | 5 |
| Durability (index) | 69 | 84 | 79 | 82 | 70 |
| Shot feel | Fairly Good | Very Poor | Poor | Very Poor | Fairly Good |

As shown in Tables 3 and 4, Examples 1–5 show longer flight distance and larger durability index than Comparative Examples 1–5 and therefore show excellent flight performance and durability. The bolls of Examples 1–5 also indicate more spin amount and show good controllability and good shot feel.

Accordingly, the golf balls of Examples 1–5 show excellent in flight performance, durability, controllability and shot feel, since they fall within the scope of claim 1 of the present invention, that is Nylon 12 and Nylon 11 have a flexural modulus within the range of 6,000 to 30,000 and Toughtec M 1943, AR 201 and Toughtec H 1052 have JIS-A hardness within 30 to 98°, and the both resins are mixed within the range of 95:5 to 50:50. The resin composition also satisfies a flexural modulus within 5,000 to 12,000 Kgf/cm$^2$.

In Comparative Example 1, the inner cover layer is formed from only polyamide resin, i.e. Nylon 12 and imparts shorter flight distance, poor durability and poor shot feel. In Comparative Example 2, the polyamide resin in the inner cover layer is contained in smaller amount and the thermoplastic elastomer is contained in larger amount. The resin composition of Comparative Example 1 shows smaller flexural modulus than the claimed range and therefore the resultant golf ball shows shorter flight distance, smaller spin amount, poor controllability and poor shot feel.

Comparative Example 3 shows shorter flight distance and poor shot feel because of the same reason as Comparative Example 2. In Comparative Example 4, the inner cover layer does not contain polyamide resin and the resin composition for the inner cover layer shows larger flexural modulus. The resultant golf ball of Comparative Example 4 shows less spin mount and indicates poor controllability, and shows poor shot feel.

In Comparative Example 5, the inner cover layer does not contain polyamide resin and shows shorter flight distance, less spin amount, poor durability and fairly good shot feel.

The invention being thus described, it will be obvious that the same may be varied in many ways. Such variations are not to be regarded as a departure from the spirit and scope of the invention, and all such modifications as would be obvious to one skilled in the art were intended to be included within the scope of the following claims.

What is claimed is:

1. A golf ball comprising a core and a cover covering said core, said cover having a two layer structure composed of an outer cover and an inner cover, wherein said inner cover is prepared from a resin composition having a flexural modulus of 5,000 to 12,000 Kgf/cm$^2$, and comprising a polyamide resin having a flexural modulus of 6,000 to 30,000 Kgf/cm$^2$ and a thermoplastic elastomer having a JIS-A hardness of 30 to 98, in a weight ratio of polyamide resin:thermoplastic elastomer within the range of 95:5 to 50:50.

2. The golf ball according to claim 1 wherein said thermoplastic elastomer for the inner cover is modified with maleic anhydride.

3. The golf ball according to claim 2 wherein said outer cover is prepared from a resin composition having a flexural modulus of 1,000 to 4,500 Kgf/cm$^2$.

4. The golf ball according to claim 1 wherein said outer cover is prepared from a resin composition having a flexural modulus of 1,000 to 4,500 Kgf/cm$^2$.

5. The golf ball according to claim 4 wherein said resin composition for the outer cover mainly comprises an ionomer resin.

6. The golf ball according to claim 1 wherein the inner cover has a thickness of 1.1 to 2.5 mm and the outer cover has a thickness of 1.1 to 2.5 mm.

7. The golf ball according to claim 1 wherein said core is a solid core formed from vulcanized rubber material.

* * * * *